US010864739B2

(12) United States Patent
Sugiura et al.

(10) Patent No.: US 10,864,739 B2
(45) Date of Patent: Dec. 15, 2020

(54) LIQUID DISCHARGE HEAD

(71) Applicant: Brother Kogyo Kabushiki Kaisha, Nagoya (JP)

(72) Inventors: Keita Sugiura, Toyokawa (JP); Shohei Koide, Nagoya (JP); Keita Hirai, Nagoya (JP); Hiroshi Katayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/661,317

(22) Filed: Oct. 23, 2019

(65) Prior Publication Data

US 2020/0207100 A1 Jul. 2, 2020

(30) Foreign Application Priority Data

Dec. 26, 2018 (JP) ..... 2018-242603

(51) Int. Cl.
*B41J 2/175* (2006.01)
*B41J 2/14* (2006.01)

(52) U.S. Cl.
CPC ..... *B41J 2/175* (2013.01); *B41J 2002/14241* (2013.01); *B41J 2002/14467* (2013.01); *B41J 2002/14491* (2013.01)

(58) Field of Classification Search
CPC ..... B41J 2/175
See application file for complete search history.

(56) References Cited

U.S. PATENT DOCUMENTS

| | | | | |
|---|---|---|---|---|
| 7,971,981 | B2 | 7/2011 | Nagashima et al. | |
| 2008/0238980 | A1 | 10/2008 | Nagashima et al. | |
| 2017/0151792 | A1 | 6/2017 | Kobayashi et al. | |
| 2018/0086076 | A1* | 3/2018 | McMullen | B41J 2/14233 |
| 2018/0264812 | A1* | 9/2018 | Matsuura | B41J 2/1404 |

FOREIGN PATENT DOCUMENTS

| | | | |
|---|---|---|---|
| JP | 2008-254196 | A | 10/2008 |
| WO | 2015-199181 | A1 | 12/2015 |

* cited by examiner

*Primary Examiner* — Lamson D Nguyen
(74) *Attorney, Agent, or Firm* — Banner & Witcoff, Ltd.

(57) ABSTRACT

A liquid discharge head includes an individual channel, a supply channel in communication with an inlet of the individual channel, and a return channel in communication with an outlet of the individual channel. The supply channel extends in a channel longitudinal direction, and communicates with a retaining chamber for retaining liquid via a supply port provided at one side with respect to the individual channel in the channel longitudinal direction. The return channel extends in the channel longitudinal direction, and communicates with the retaining chamber via a return port provided at the one side with respect to the individual channel in the channel longitudinal direction. The inlet and the outlet are located at the same position in the channel longitudinal direction.

13 Claims, 7 Drawing Sheets

LIQUID DISCHARGE HEAD

CROSS REFERENCE TO RELATED APPLICATION

The present application claims priority from Japanese Patent Application No. 2018-242603 filed on Dec. 26, 2018, the disclosure of which is incorporated herein by reference in its entirety.

BACKGROUND

Field of the Invention

The present invention relates to a liquid discharge head including an individual channel, a supply channel, and a return channel.

Description of the Related Art

Conventionally, there is known a liquid discharge head including a first common channel (supply channel) and a second common channel (return channel) extending respectively in a first direction (extending direction). In the above liquid discharge head, the first common channel and the second common channel are in communication with a liquid tank (retaining chamber) via openings (a supply port and a return port) provided at one side in the first direction with respect to a discharging element (individual channel). By virtue of this, it is possible to make the range of distribution of the pressure applied on the discharging element small, and the meniscus of the nozzle is maintained.

SUMMARY

However, in the discharging element (individual channel) of the above liquid discharge head, positions are different from each other in the first direction (extending direction) between the inlet in communication with the first common channel (supply channel) and the outlet in communication with the second common channel (return channel). Therefore, there is a large difference in the absolute value of the pressures applied on the inlet and the outlet of the individual channel, and discharging may not be stable.

An object of the present teaching is to provide a liquid discharge head capable of preventing the unstable discharging.

According to a first aspect of the present teaching, there is provided a liquid discharge head including: an individual channel; a supply channel in communication with an inlet of the individual channel; and a return channel in communication with an outlet of the individual channel, wherein the supply channel extends in a channel longitudinal direction, and communicates with a retaining chamber for retaining liquid, via a supply port provided at one side in the channel longitudinal direction with respect to the individual channel, wherein the return channel extends in the channel longitudinal direction, and communicates with the retaining chamber, via a return port provided at the one side in the channel longitudinal direction with respect to the individual channel, wherein the individual channel has: a nozzle; a pressure chamber in communication with the nozzle; a connecting channel connecting the pressure chamber and the nozzle; a first link channel having one end as the inlet and the other end linking to the pressure chamber; and a second link channel having one end as the outlet and the other end linking to the connecting channel, and wherein the inlet and the outlet are located at the same position in the channel longitudinal direction.

According to a second aspect of the present teaching, there is provided a liquid discharge head including: an individual channel; a supply channel in communication with an inlet of the individual channel; and a return channel in communication with an outlet of the individual channel, wherein the supply channel extends in a channel longitudinal direction, and communicates with a retaining chamber for retaining liquid, via a supply port provided at one side in the channel longitudinal direction with respect to the individual channel, wherein the return channel extends in the channel longitudinal direction, and communicates with the retaining chamber, via a return port provided at the one side in the channel longitudinal direction with respect to the individual channel, wherein the individual channel has: a nozzle; a first pressure chamber in communication with the nozzle; a second pressure chamber in communication with the nozzle; a first connecting channel connecting the first pressure chamber and the nozzle; a second connecting channel connecting the second pressure chamber and the nozzle; a first link channel having one end as the inlet and the other end linking to the first pressure chamber; and a second link channel having one end as the outlet and the other end linking to the second pressure chamber, and wherein the inlet and the outlet are located at the same position in the channel longitudinal direction.

DESCRIPTION OF THE EMBODIMENTS

First Embodiment

Figure 1:
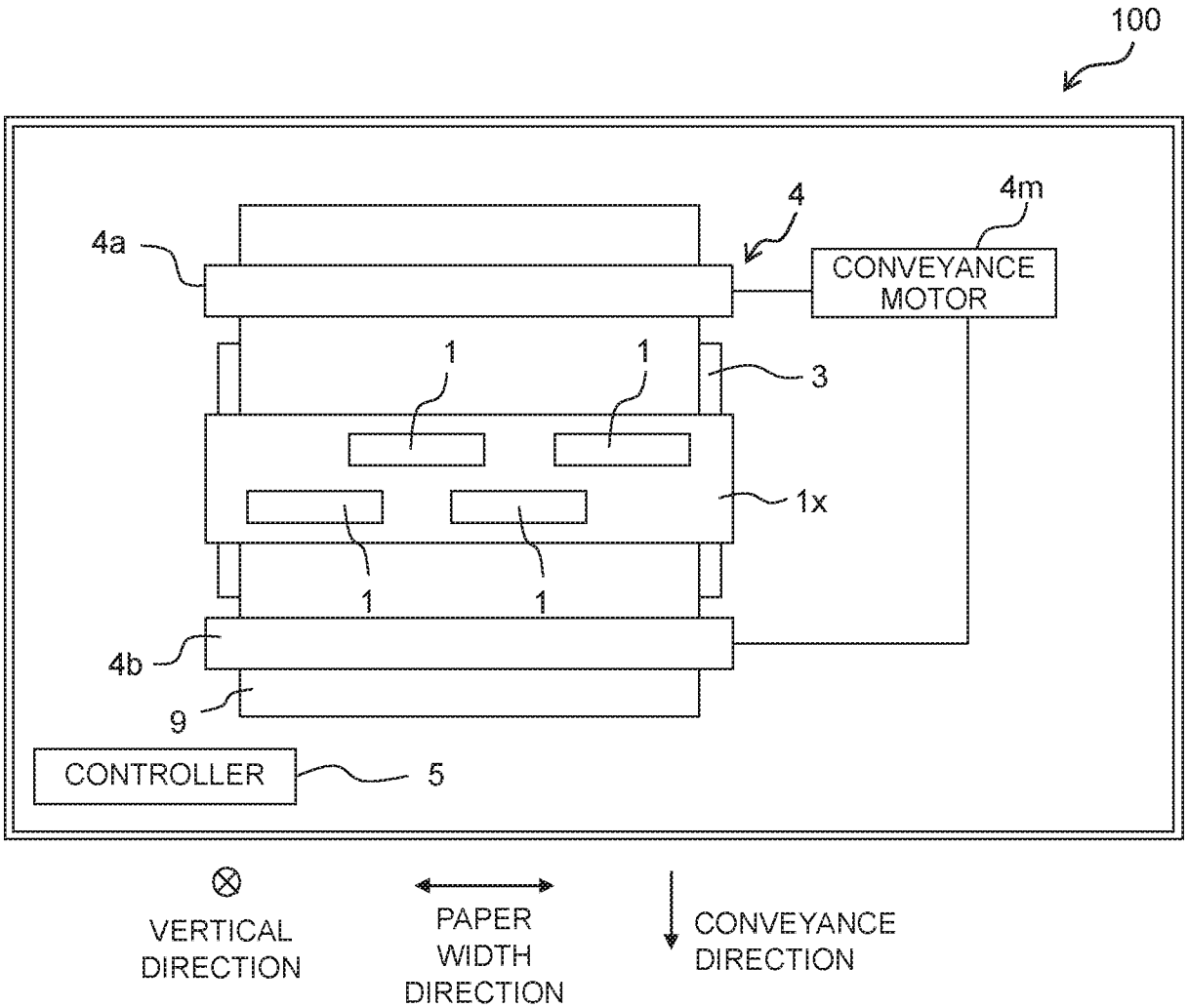
FIG. 1 is a plan view of a printer including heads according to a first embodiment of the present teaching.

First, an explanation will be made on a schematic configuration of a printer 100 including heads 1 according to a first embodiment of the present teaching.

The printer 100 is provided with a head unit 1*x* including four heads 1, a platen 3, a conveyance mechanism 4, and a controller 5.

Recording paper 9 is placed on the upper surface of the platen 3.

The conveyance mechanism 4 has two roller pairs 4*a* and 4*b* arranged to interpose the platen 3 therebetween in a conveyance direction. If a conveyance motor 4*m* is driven under the control of the controller 5, then the roller pairs 4*a* and 4*b* rotate while nipping the recording paper 9 to convey the recording paper 9 in the conveyance direction.

The head unit 1*x* is elongated along a paper width direction (a direction orthogonal to both the conveyance direction and a vertical direction), and is a line type to discharge an ink to the recording paper 9 from nozzles 21

(see FIGS. 2 and 3) with its position being fixed. The four heads 1 are arranged in a zigzag pattern along the paper width direction.

The controller 5 has a ROM (Read Only Memory), a RAM (Random Access Memory), and an ASIC (Application Specific Integrated Circuit). The ASIC carries out a recording process and the like according to programs stored in the ROM. In the recording process, based on a recording command (including image data) inputted from an external device such as a PC or the like, the controller 5 controls the conveyance motor 4*m* and a driver IC 1*d* (see FIG. 3) of each head 1 to record an image on the recording paper 9.

Next, referring to FIGS. 2 and 3, the configuration of the heads 1 will be explained.

Each head 1 has a channel substrate 11 and an actuator unit 12.

Figure 2:
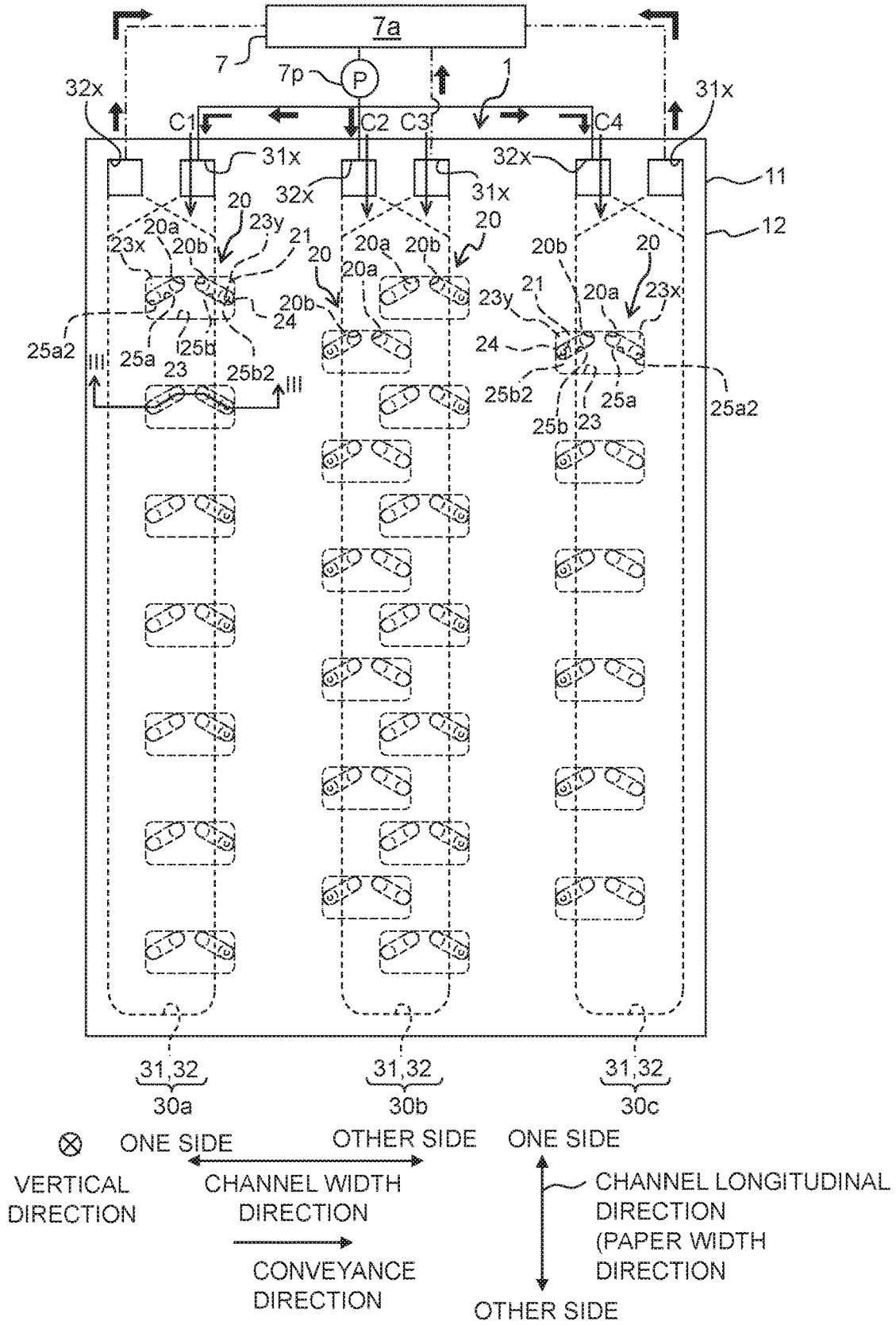
FIG. 2 is a plan view of a head.
Figure 3:
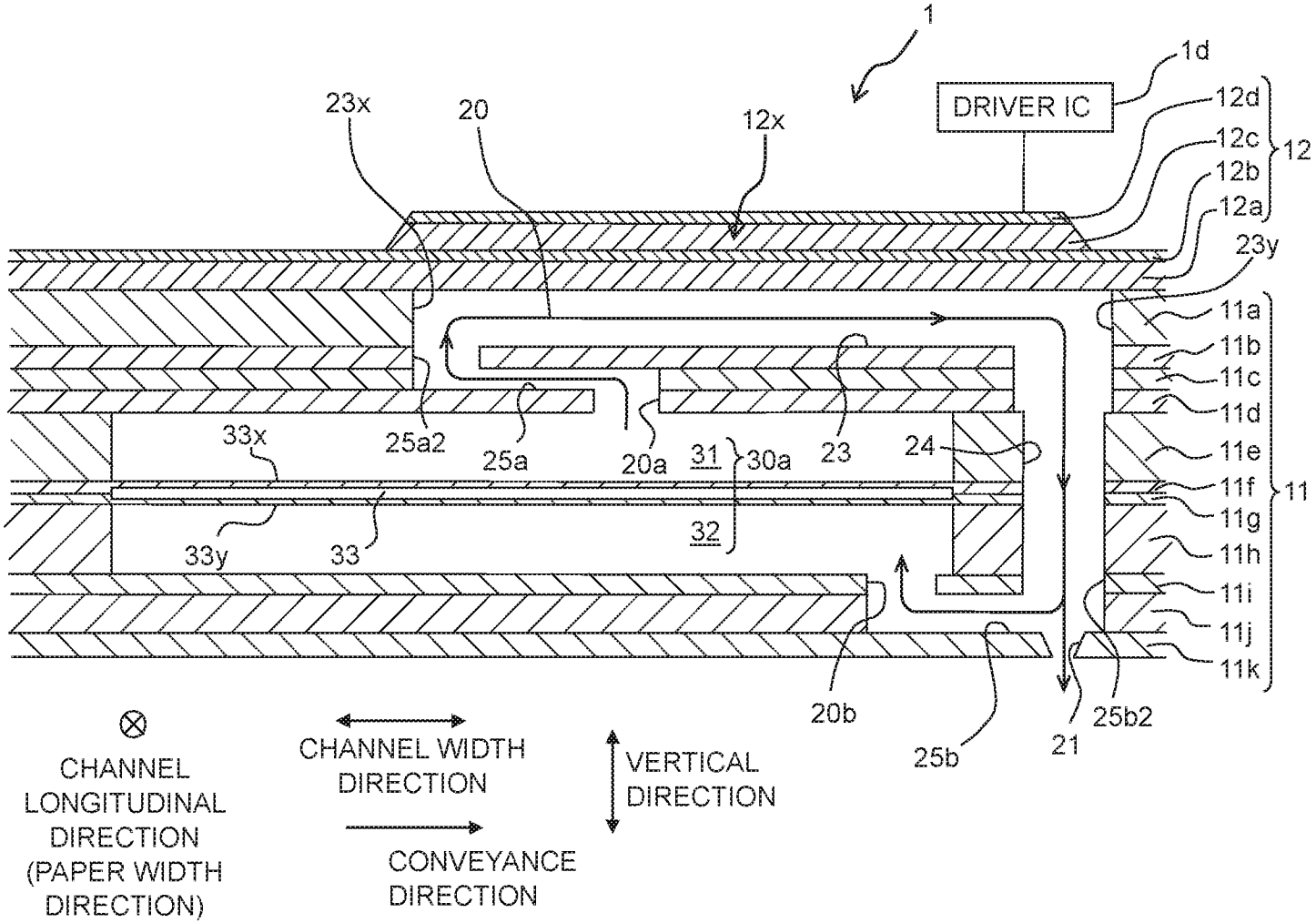
FIG. 3 is a cross section view of the head along the line of FIG. 2.

As depicted in FIG. 3, the channel substrate 11 has eleven plates 11*a* to 11*k* attached to each other and layered along the vertical direction. Each of the plates 11*a* to 11*k* is formed therein with through holes to form a channel. This channel includes three common channel groups 30*a* to 30*c*, and a number of individual channels 20 (see FIG. 2).

Each of the three common channel groups 30*a* to 30*c* is formed from one supply channel 31 and one return channel 32 aligning in the vertical direction. The supply channel 31 and the return channel 32 extend respectively in a channel longitudinal direction (the paper width direction in the first embodiment). The three common channel groups 30*a* to 30*c* align in a channel width direction (a direction parallel to the conveyance direction in the first embodiment) as depicted in FIG. 2. The channel width direction is the width direction of the respective supply channel 31 and return channel 32, being orthogonal to the channel longitudinal direction.

Each supply channel 31 is in communication with a retaining chamber 7*a* of a sub-tank 7 via a supply port 31*x* provided at one side of the individual channels 20 in the channel longitudinal direction. Each return channel 32 is in communication with the retaining chamber 7*a* via a return port 32*x* also provided at the one side of the individual channels 20 in the channel longitudinal direction. The supply ports 31*x* and the return ports 32*x* are provided at the (same) one side of the individual channels 20 in the channel longitudinal direction and in the same position in the channel longitudinal direction. The supply ports 31*x* and the return ports 32*x* are open in the upper surface of the channel substrate 11. The supply ports 31*x* and the return ports 32*x* for the respective common channel groups 30*a* to 30*c* align in the channel width direction.

The retaining chamber 7*a* is in communication with a main tank (not depicted) retaining the ink, to retain the ink supplied from the main tank.

The individual channels 20 form four arrays (rows) aligning in the channel width direction (a first individual channel array C1, a second individual channel array C2, a third individual channel array C3, and a fourth individual channel array C4). The first individual channel array C1 is positioned at one side of the second individual channel array C2 in the channel width direction (upstream in the conveyance direction). The second individual channel array C2 is positioned at one side of the third individual channel array C3 in the channel width direction. The third individual channel array C3 is positioned at one side of the fourth individual channel array C4 in the channel width direction. In each of the first to fourth individual channel arrays C1 to C4, the individual channels 20 align at equal distances in the channel longitudinal direction. The individual channels 20 belonging to the first individual channel array C1 are in communication with the supply channel 31 and the return channel 32 constituting the common channel group 30*a* arranged at one end in the channel width direction among the three common channel groups 30*a* to 30*c*. The individual channels 20 belonging to the fourth individual channel array C4 are in communication with the supply channel 31 and the return channel 32 constituting the common channel group 30*c* arranged at the other end in the channel width direction (downstream in the conveyance direction) among the three common channel groups 30*a* to 30*c*. The individual channels 20 belonging to the second individual channel array C2 and third individual channel array C3 are in communication with the supply channel 31 and the return channel 32 constituting the common channel group 30*b* arranged at the center in the channel width direction among the three common channel groups 30*a* to 30*c*. The individual channels 20 belonging to the second individual channel array C2 and third individual channel array C3 are arranged zigzag in the channel longitudinal direction. Further, the individual channels 20 belonging to the second individual channel array C2 overlap partially with the individual channels 20 belonging to the third individual channel array C3, along the channel longitudinal direction.

Each of the individual channels 20 includes a nozzle 21, a pressure chamber 23, a connecting channel 24, a first link channel 25*a*, and a second link channel 25*b*.

As depicted in FIG. 3, the nozzle 21 is constructed of a through hole formed in the plate 11*k*, being open in the lower surface of the channel substrate 11. The pressure chamber 23 is constructed of a through hole formed in the plate 11*a*, being open in the upper surface of the channel substrate 11 to be covered by the actuator unit 12. The connecting channel 24 is constructed of a through hole formed in the plates 11*b* to 11*i*. The first link channel 25*a* is constructed of a through hole formed in the plates 11*b* to 11*d*. The second link channel 25*b* is constructed of a through hole formed in the plates 11*i* and 11*j*.

As depicted in FIG. 2, in each of the first to fourth individual channel arrays C1 to C4, the nozzles 21 align at equal distances in the channel longitudinal direction. The nozzles 21 belonging to two adjacent individual channel arrays in the channel width direction are arranged zigzag in the channel longitudinal direction.

Each pressure chamber 23 has a sufficiently rectangular shape extending in the channel width direction and being elongated in the channel width direction as viewed from the vertical direction. In each of the first to fourth individual channel arrays C1 to C4, the pressure chambers 23 align at equal distances in the channel longitudinal direction. The pressure chambers 23 belonging to two adjacent individual channel arrays in the channel width direction are arranged zigzag in the channel longitudinal direction.

As depicted in FIG. 3, each connecting channel 24 extends in the vertical direction from another end 23*y* of the pressure chamber 23 in the channel width direction. The connecting channel 24 is connected to the center of the pressure chamber 23 according to a width direction (the channel width direction in the first embodiment), at the other end 23*y* (see FIG. 2). The lower end of the connecting channel 24 is right above the nozzle 21. That is, the connecting channel 24 is connected with the pressure chamber 23 and the nozzle 21.

Each first link channel 25*a* links the supply channel 31 and the pressure chamber 23. The first link channel 25*a* has one end (an inlet 20*a* of the individual channel 20) linking to the supply channel 31, and another end 25*a*2 linking to one end 23*x* of the pressure chamber 23 in the channel width direction. The other end 25*a*2 is positioned in the center of the pressure chamber 23 (see FIG. 2) according to the width direction (the channel longitudinal direction in the first embodiment) at the one end 23*x*.

Each second link channel 25*b* links the return channel 32 and the connecting channel 24. The second link channel 25*b* has one end (an outlet 20*b* of the individual channel 20) linking to the return channel 32, and another end 25*b*2 linking to the connecting channel 24. The nozzle 21 is positioned right below the other end 25*b*2.

Each pressure chamber 23 is in communication with the nozzle 21 via the connecting channel 24 and the second link channel 25*b*.

In each pair, the first link channel 25*a* and the second link channel 25*b* are arranged to extend respectively in an oblique direction (a direction intersecting both the channel width direction and the channel longitudinal direction), as depicted in FIG. 2, and to be symmetrical in the channel width direction with respect to such a straight line along the channel longitudinal direction as passes through the center of the pressure chamber 23 according to the channel width direction. One end (the inlet 20*a*) of the first link channel 25*a* is positioned at one side in the channel longitudinal direction across from the other end 25*a*2 of the first link channel 25*a*. One end (the outlet 20*b*) of the second link channel 25*b* is positioned at one side in the channel longitudinal direction across from the other end 25*b*2 of the second link channel 25*b*. That is, in each of the first link channels 25*a* and the second link channels 25*b*, one end (the inlet 20*a* or the outlet 20*b*) is positioned closer to the supply port 31*x* and the return port 32*x* than the other end 25*a*2 or 25*b*2. Further, the (channel) resistance of the first link channels 25*a* is the same as the resistance of the second link channels 25*b*.

In each individual channel 20, the inlet 20*a* and the outlet 20*b* are located at one side of the nozzle 21 in the channel longitudinal direction (both at the same side), and at the same position in the channel longitudinal direction. Further, in each individual channel 20, the distance from the supply port 31*x* to the inlet 20*a* in the channel longitudinal direction is the same as the distance from the outlet 20*b* to the return port 32*x* in the channel longitudinal direction. Further, in each individual channel 20, the channel resistance from the supply port 31*x* to the inlet 20*a* is the same as the channel resistance from the outlet 20*b* to the return port 32*x*. Further, in each pair, the supply channel 31 and the return channel 32 have the same length respectively along the channel width direction and along the vertical direction, and have the same cross section area of channel.

In the first embodiment, each outlet 20*b* is positioned at the end of the return channel 32 in the channel width direction (in detail, at the end of the return channel 32 closer to the nozzle 21 of the corresponding individual channel 20 between the two ends of the return channel 32 in the channel width direction).

The supply channel 31 constituting the common channel group 30*a* is in communication with the inlets 20*a* of the individual channels 20 belonging to the first individual channel array C1. The return channel 32 constituting the common channel group 30*a* is in communication with the outlets 20*b* of the individual channels 20 belonging to the first individual channel array C1. The supply channel 31 constituting the common channel group 30*c* is in communication with the inlets 20*a* of the individual channels 20 belonging to the fourth individual channel array C4. The return channel 32 constituting the common channel group 30*c* is in communication with the outlets 20*b* of the individual channels 20 belonging to the fourth individual channel array C4. The supply channel 31 constituting the common channel group 30*b* is in communication with the inlets 20*a* of the individual channels 20 belonging to the second individual channel array C2 and the third individual channel array C3. The return channel 32 constituting the common channel group 30*b* is in communication with the outlets 20*b* of the individual channels 20 belonging to the second individual channel array C2 and the third individual channel array C3.

In the supply channel 31 constituting the common channel group 30*b*, the inlets 20*a* of the individual channels 20 belonging to the second individual channel array C2 and the third individual channel array C3 are arranged zigzag in the channel longitudinal direction. In the return channel 32 constituting the common channel group 30*b*, the outlets 20*b* of the individual channels 20 belonging to the second individual channel array C2 and the third individual channel array C3 are also arranged zigzag in the channel longitudinal direction.

Between the supply channel 31 and the return channel 32 constituting each of the common channel groups 30*a* to 30*c*, as depicted in FIG. 3, a damper chamber 33 is provided. The damper chamber 33 is constructed from a recess formed in the plate 11*f* and another recess formed in the plate 11*g*. The bottom of the recess in the plate 11*f* functions as a damper film 33*x* defining the lower surface of the supply channel 31. The bottom of the recess in the plate 11*g* functions as a damper film 33*y* defining the upper surface of the return channel 32. The damper film 33*x* is provided on the other side than the inlet 20*a* in the vertical direction across the supply channel 31. The damper film 33*y* is provided on the other side than the outlet 20*b* in the vertical direction across the return channel 32.

In such a channel configuration as described above, the ink flows in the channel substrate 11 in the following manner. The thick arrows in FIGS. 2 and 3 indicate the ink flow.

With a circulation pump 7*p* being driven under the control of the controller 5, the ink in the retaining chamber 7*a* is supplied to the supply channel 31 from the supply port 31*x* of each of the common channel groups 30*a* to 30*c*. The ink supplied to the supply channel 31 moves from one part to the other part in the supply channel 31 along the channel longitudinal direction, while being supplied to each individual channel 20. The ink having flowed into each individual channel 20 from the supply channel 31 moves in the individual channel 20 in an aftermentioned manner, and then flows into the return channel 32. Then, the ink moves from another part to one part in the return channel 32 along the channel longitudinal direction to return to the retaining chamber 7*a* via the return port 32*x*.

The ink having flowed into the individual channel 20 flows into the pressure chamber 23 from the inlet 20*a* through the first link channel 25*a*, moves sufficiently horizontally in the pressure chamber 23, and then moves downward through the connecting channel 24. Passing through the connecting channel 24, the ink arrives at the other end 25*b*2 of the second link channel 25*b* such that part of the same is discharged from the nozzle 21, and the rest passes through the second link channel 25*b* and flows into the return channel 32 from the outlet 20*b*.

In this manner, by circulating the ink between the subtank 7 and the channel substrate 11, it is realized to eliminate air bubbles and prevent ink thickening in the supply channels 31, the return channels 32 and the individual channels 20 formed in the channel substrate 11. Further, if the ink includes precipitation ingredients (for example, ingredients which may precipitate such as some pigments and the like), then it is possible to prevent such ingredients from precipitating.

The actuator unit 12 is arranged on the upper surface of the channel substrate 11 to cover the pressure chambers 23 of all individual channels 20 formed in the channel substrate 11.

As depicted in FIG. 3, the actuator unit 12 includes, in order from below, a vibration plate 12*a*, a common electrode 12*b*, a number of piezoelectric bodies 12*c*, and a number of individual electrodes 12*d*. The vibration plate 12*a* and the common electrode 12*b* are arranged on the sufficiently entire upper surface of the channel substrate 11 to cover the pressure chambers 23 of all individual channels 20 formed in the channel substrate 11. On the other hand, the piezoelectric bodies 12*c* and the individual electrodes 12*d* are provided according to each pressure chamber 23 to face the pressure chambers 23 respectively.

The individual electrodes 12*d* and the common electrode 12*b* are connected electrically with the driver IC 1*d*. The driver IC 1*d* keeps the common electrode 12*b* at the ground potential but changes the potential of each individual electrode 12*d*. In particular, the driver IC 1*d* generates a drive signal based on a control signal from the controller 5, and applies the drive signal to an individual electrode(s) 12*d*. By virtue of this, the individual electrode 12*d* changes between a predetermined drive potential and the ground potential. On this occasion, in the vibration plate 12*a* and the piezoelectric body 12*c*, the part interposed between the individual electrode 12*d* and the pressure chamber 23 (i.e., an actuator 12*x*) is deformed to project toward the pressure chamber 23 such that the pressure chamber 23 changes in volume and applies a pressure to the ink in the pressure chamber 23 so as to discharge the ink from the nozzle 21. The actuator unit 12 has a plurality of actuators 12*x* respectively facing the pressure chambers 23.

As described above, according to the first embodiment, the inlets 20*a* and the outlets 20*b* of the individual channels 20 are located at the same position in the channel longitudinal direction (see FIG. 2). In this case, it is easy to realize a configuration of the distance from the supply port 31*x* to the inlet 20*a* in the channel longitudinal direction being the same as the distance from the outlet 20*b* to the return port 32*x* in the channel longitudinal direction for each individual channel 20. According to this configuration, in each individual channel 20, it is possible to equalize the pressure loss from the supply port 31*x* to the inlet 20*a* to the pressure loss from the outlet 20*b* to the return port 32*x*. Therefore, it is possible to comparatively easily equalize the absolute values of the pressures on the inlet 20*a* and the outlet 20*b* of the individual channel 20 (by applying the positive and negative pressures at the same magnitude respectively on the supply port 31*x* and the return port 32*x*, for example). By virtue of this, it is possible to reliably maintain the meniscus of the nozzle 21, and thus to prevent the unstable discharging.

The supply channels 31 and the return channels 32 align in the vertical direction (see FIG. 3: a direction orthogonal to both the channel width direction and the channel longitudinal direction). In this case, compared to the case where the supply channels 31 and the return channels 32 align in the channel width direction, it is possible to downsize the heads 1 in the channel width direction.

In each pair, the first link channel 25*a* and the second link channel 25*b* extend in the oblique direction (see FIG. 2: a direction intersecting both the channel width direction and the channel longitudinal direction). In this case, under a certain condition that there is a constant length of each of the link channels 25*a* and 25*b*, compared to the case where the first link channel 25*a* and the second link channel 25*b* extend in the channel width direction, it is possible to reduce the lengths of the first link channel 25*a* and the second link channel 25*b*, and thus to downsize the heads 1 in the channel width direction.

The one end (the inlet 20*a*) of the first link channel 25*a* is positioned at one side in the channel longitudinal direction as in reference to the other end 25*a*2 of the first link channel 25*a* (see FIG. 2). The one end (the outlet 20*b*) of the second link channel 25*b* is positioned at one side in the channel longitudinal direction as in reference to the other end 25*b*2 of the second link channel 25*b*. That is, in each pair of the first link channel 25*a* and the second link channel 25*b*, one end (the inlet 20*a* or the outlet 20*b*) is positioned closer to the supply port 31*x* and the return port 32*x* than the other end 25*a*2 or 25*b*2. In this case, because the absolute values of the pressures applied on the inlet 20*a* and the outlet 20*b* are large, there is more flow quantity of the ink supplied to the nozzle 21 such that it is possible to prevent under-refill phenomenon.

In each pair, the first link channel 25*a* and the second link channel 25*b* are arranged to be symmetrical with respect to the channel width direction (see FIG. 2). In this case, in the first link channel 25*a* and the second link channel 25*b*, there is a small difference in inertial resistance (a resistance due to a local part loss; a resistance depending on the flow speed and arising from the part of sudden expansion or contraction of the channel, from the part of curvature of the channel, etc.). Therefore, there is a small difference in pressure loss. By virtue of this, it is easy to adjust pressure for the individual channel 20.

The first link channel 25*a* has the same resistance as the second link channel 25*b*. In this case, there is a small difference in the pressure loss between the first link channel 25*a* and the second link channel 25*b* such that it is easy to adjust pressure for the individual channel 20.

The damper film 33*y* is provided at the other side than the outlet 20*b* in the vertical direction (an orthogonal direction orthogonal to the channel longitudinal direction) with respect to the return channel 32 (see FIG. 3). The outlet 20*b* is positioned at the end of the return channel 32 in the channel width direction (the direction orthogonal to both the channel longitudinal direction and the orthogonal direction). If the outlet 20*b* is positioned at the center of the return channel 32 in the channel width direction, then along with the deformation of the damper film 33*y*, if the return channel 32 deforms to project downward, then the width of the second link channel 25*b* in the lower part of the return channel 32 will be narrowed such that the channel resistance increases to cause a possible difficulty in discharging air bubbles via the second link channel 25*b*. In the first embodiment, however, because the outlet 20*b* is positioned at the end of the return channel 32 in the channel width direction, even if the damper film 33*y* deforms, it is still difficult to narrow the width of the second link channel 25*b* such that it is possible to prevent the above problem.

In the return channel 32, the outlets 20*b* of the individual channels 20 are arranged zigzag along the channel longitudinal direction (see FIG. 2). In this case, compared to the case of aligning the outlets 20*b* in one array in the channel longitudinal direction, there is an improved effect of stirring the precipitation ingredients because whirls take place easily inside the return channel 32.

The distance from the supply port 31*x* to the inlet 20*a* in the channel longitudinal direction is the same as the distance from the outlet 20*b* to the return port 32*x* in the channel longitudinal direction (see FIG. 2). In this case, it is possible to more reliably equalize the absolute values of the pressures on the inlet 20*a* and the outlet 20*b* of the individual channel 20. By virtue of this, it is possible to reliably maintain the meniscus of the nozzle 21, and thus to prevent the unstable discharging.

The channel resistance from the supply port 31*x* to the inlet 20*a* is the same as the channel resistance from the outlet 20*b* to the return port 32*x*. In this case, it is possible to more reliably equalize the absolute values of the pressures on the inlet 20*a* and the outlet 20*b* of the individual channel 20, and thus it is possible to prevent the unstable discharging.

Second Embodiment

Next, referring to FIGS. 4 and 5, a head 201 according to a second embodiment of the present teaching will be explained. In the second embodiment, the configuration of the individual channels 20 is different from that in the first embodiment.

In the first embodiment (FIGS. 2 and 3), the outlet 20*b* of each individual channel 20 is positioned at the end of the return channel 32 in the channel width direction. However, in the second embodiment (FIGS. 4 and 5), the outlet 20*b* is positioned at the center of the return channel 32 in the channel width direction. In the second embodiment, in each return channel 32, the outlets 20*b* of the individual channels 20 are arranged in one array in the channel longitudinal direction.

In the first embodiment (FIGS. 2 and 3), the inlet 20*a* of each individual channel 20 is positioned sufficiently at the center of the supply channel 31 in the channel width direction. However, in the second embodiment (FIGS. 4 and 5), the inlet 20*a* is positioned at the end of the supply channel 31 in the channel width direction (in detail, at the end of that individual channel 20 at the closer side to the nozzle 21 between the two ends of the supply channel 31 in the channel width direction).

Figure 4:
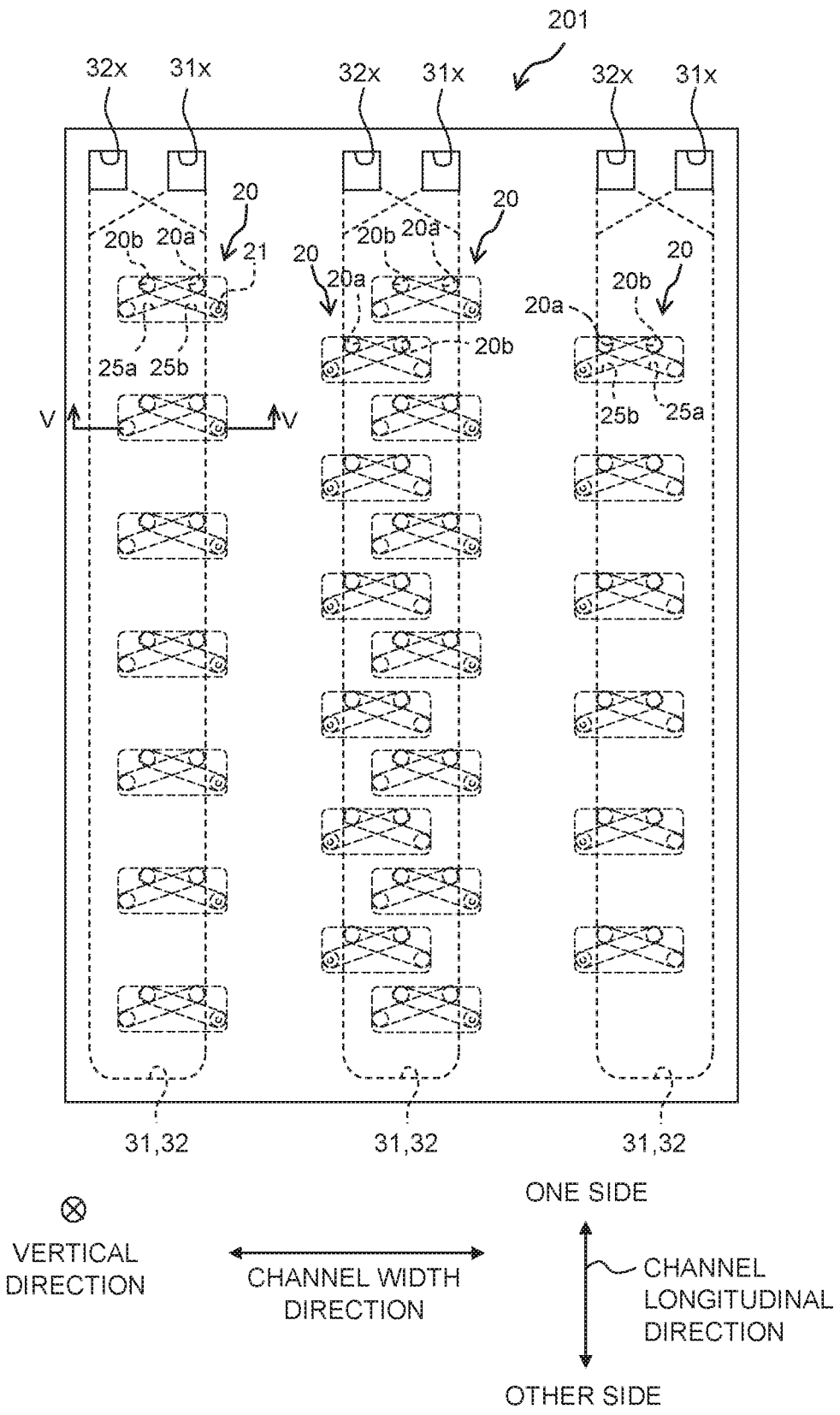
FIG. 4 is a plan view of a head according to a second embodiment of the present teaching.
Figure 5:
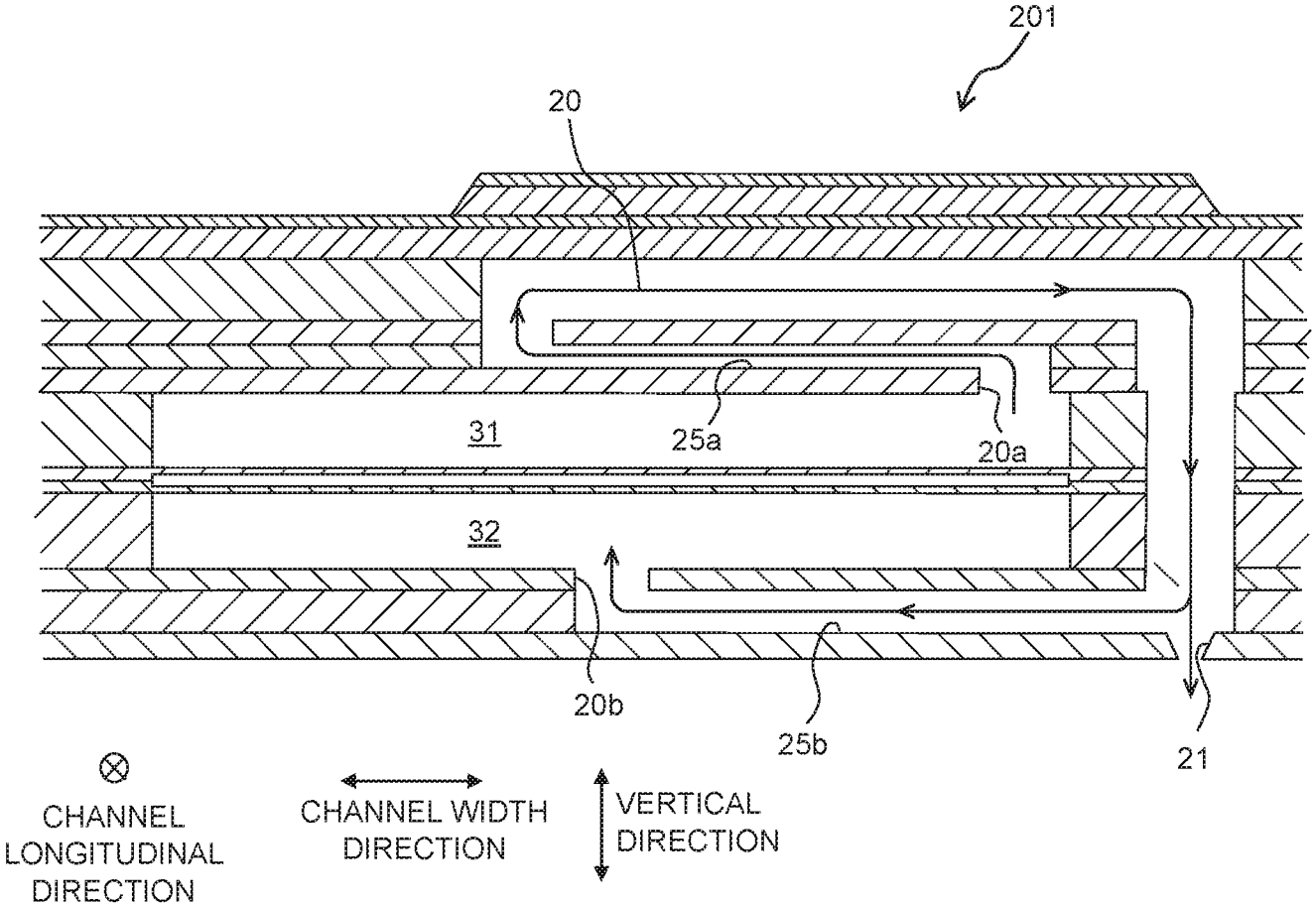
FIG. 5 is a schematic cross section view of the head along the line V-V of FIG. 4.

In each pair, the first link channel 25*a* and the second link channel 25*b* are arranged in the same manner as in the first embodiment (FIG. 2) to extend respectively in the oblique direction (the direction intersecting both the channel width direction and the channel longitudinal direction), as depicted in FIG. 4, and to be symmetrical in the channel width direction with respect to the straight line along the channel longitudinal direction and through the center of the pressure chamber 23 according to the channel width direction. However, because of the difference in position between the inlet 20*a* and the outlet 20*b*, the first link channel 25*a* and the second link channel 25*b* are longer than those in the first embodiment, and intersect each other as viewed from the vertical direction.

In each individual channel 20, in the same manner as in the first embodiment, the inlet 20*a* and the outlet 20*b* are located at the one side of the nozzle 21 in the channel longitudinal direction (both at the same side), and at the same position in the channel longitudinal direction.

As described above, according to the second embodiment, whereas the configuration of the individual channels 20 is different from that in the first embodiment, the inlet 20*a* and the outlet 20*b* of each individual channel 20 are located at the same position in the channel longitudinal direction. Therefore, in the same manner as in the first embodiment, it is possible to equalize the absolute values of the pressures on the inlet 20*a* and the outlet 20*b* of the individual channel 20, and thus it is possible to prevent the unstable discharging.

Further, in the second embodiment, the outlet 20*b* is positioned at the center of the return channel 32 in the channel width direction. Hence, the ink speed flowing through the return channel 32 is maximized at the center of the return channel 32 in the channel width direction. By providing the outlet 20*b* in the part where the flow speed is large, it is possible to smoothly discharge the air bubbles let out from the outlet 20*b* via the return channel 32.

Third Embodiment

Next, referring to FIGS. 6 and 7, a head 301 according to a third embodiment of the present teaching will be explained. In the third embodiment, the number and arrangement of supply channels 31 and return channel 32, and the configuration of individual channels 20 are different from that in the first embodiment.

Figure 6:
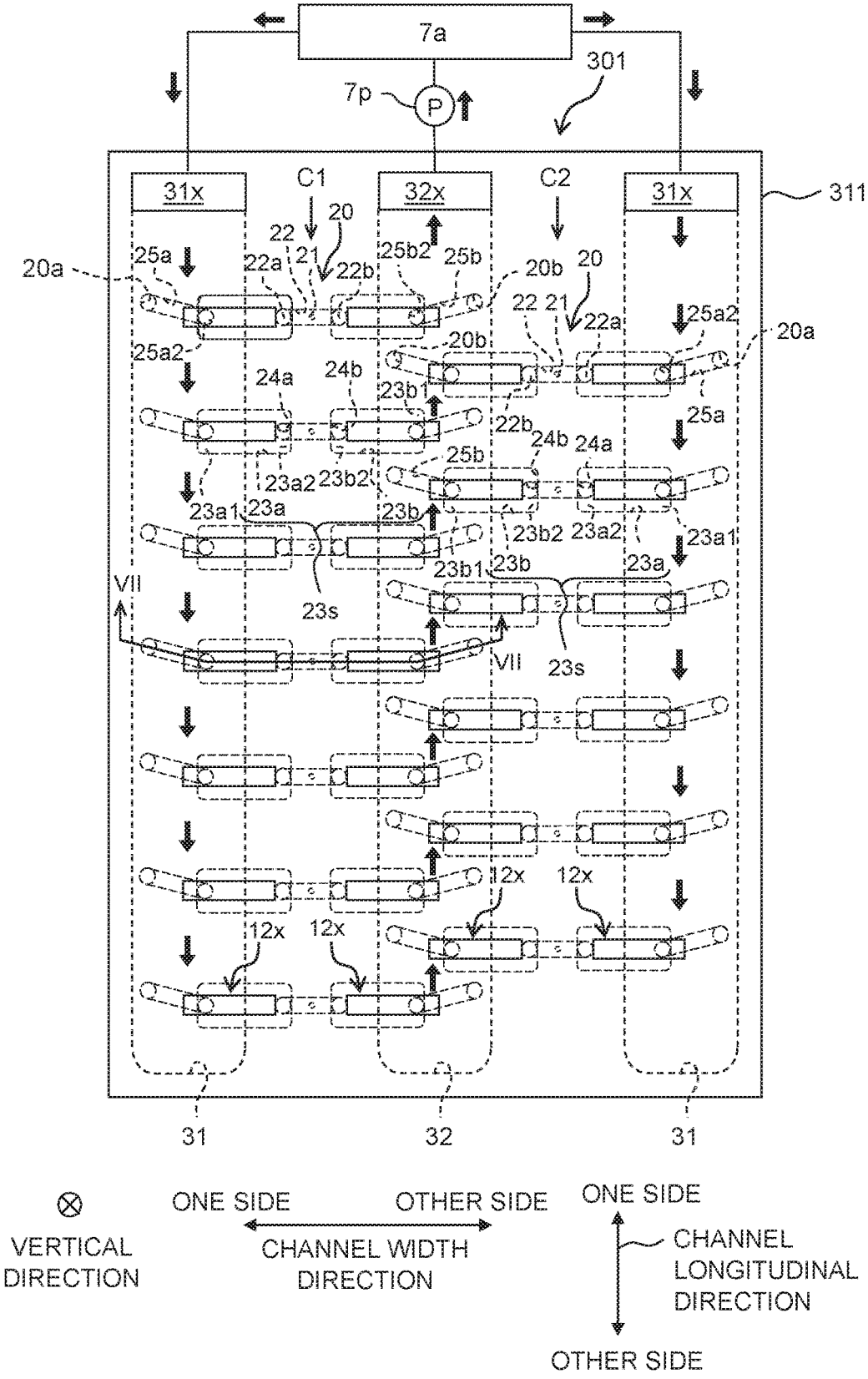
FIG. 6 is a plan view of a head according to a third embodiment of the present teaching.

As depicted in FIG. 6, in the third embodiment, two supply channels 31 and one return channel 32 align alternately in the channel width direction, and the one return channel 32 is arranged between the two supply channels 31 in the channel width direction.

Figure 7:
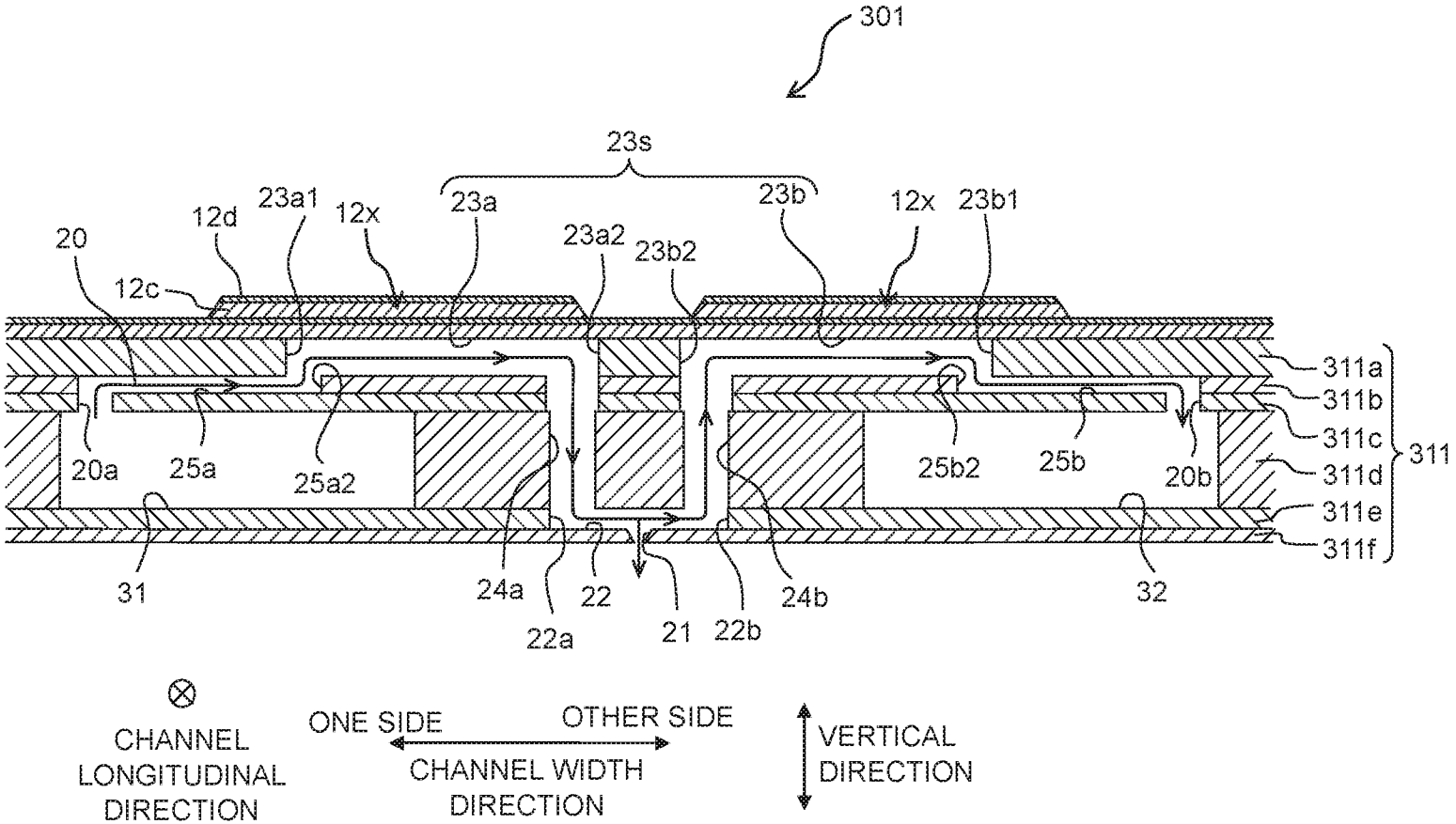
FIG. 7 is a cross section view of the head along the line VII-VII of FIG. 6.

A channel substrate 311 has, as depicted in FIG. 7, six plates 311*a* to 311*f* attached to each other and layered along the vertical direction. The plate 311*d* is formed therein with the two supply channels 31 and the one return channel 32 (see FIG. 6). The plates 311*a* to 311*f* are formed therein with a number of individual channels 20 (see FIG. 6).

The individual channels 20 form two arrays aligning in the channel width direction (a first individual channel array C1 and a second individual channel array C2). The first individual channel array C1 is positioned at one side of the second individual channel array C2 in the channel width direction. In each of the first and second individual channel arrays C1 and C2, the individual channels 20 align at equal distances in the channel longitudinal direction. The individual channels 20 belonging to the first individual channel array C1 and second individual channel array C2 are arranged zigzag in the channel longitudinal direction. The individual channels 20 belonging to the first individual channel array C1 overlap partially with the individual channels 20 belonging to the second individual channel array C2, along the channel longitudinal direction.

The individual channels 20 belonging to the first individual channel array C1 link the supply channel 31 (the one arranged at one side of the return channel 32 in the channel width direction between the two supply channels 31) and the return channel 32 which are adjacent to each other in the channel width direction. The individual channels 20 belonging to the second individual channel array C2 link the supply channel 31 (the one arranged at the other side of the return channel 32 in the channel width direction between the two supply channels 31) and the return channel 32 which are adjacent to each other in the channel width direction.

Each of the individual channels 20 includes a nozzle 21, a communication channel 22, a first pressure chamber 23*a*, a second pressure chamber 23*b*, a first connecting channel 24*a*, a second connecting channel 24*b*, a first link channel 25*a*, and a second link channel 25*b*. In the third embodiment, in each individual channel 20, by simultaneously driving two actuators 12*x* facing the two pressure chambers 23*a* and 23*b* respectively, it is possible to increase the flying speed of the ink discharged from the nozzle 21.

As depicted in FIG. 7, the nozzle 21 is constructed of a through hole formed in the plate 311*f* being open in the lower surface of the channel substrate 311. The communication channel 22 is constructed of a through hole formed in the plate 311*e*. The first pressure chamber 23*a* and the second pressure chamber 23*b* are constructed of through holes formed in the plate 311*a*, respectively, being open in the upper surface of the channel substrate 311. The first connecting channel 24*a* and the second connecting channel 24*b* are constructed of through holes formed in the plates 311*b* to 311*d*, respectively. The first link channel 25*a* and the second link channel 25*b* are constructed of through holes formed in the plates 311*b* and 311*c*, respectively.

As depicted in FIG. 6, in each of the first and second individual channel arrays C1 and C2, the nozzles 21 align at equal distances in the channel longitudinal direction. The nozzles 21 belonging to the first individual channel array C1 and the second individual channel array C2 (that is, all nozzles 21 formed in the channel substrate 311) are arranged zigzag in the channel longitudinal direction. By virtue of this, each nozzle 21 is positioned differently from any other nozzles 21 in the channel longitudinal direction.

Further, as depicted in FIG. 6, in each pair, the first pressure chamber 23*a* and the second pressure chamber 23*b* have a sufficiently rectangular shape, respectively, extending in the channel width direction and being elongated in the channel width direction as viewed from the vertical direction. In each individual channel 20, the first pressure chamber 23*a* and the second pressure chamber 23*b* are located at the same position in the channel longitudinal direction, and separated from each other in the channel width direction. Then, in each of the first and second individual channel arrays C1 and C2, a number of pressure chamber groups 23*s*, which are formed from the first pressure chambers 23*a* and the second pressure chambers 23*b* belonging to the respective individual channels 20, align at equal distances in the channel longitudinal direction. The pressure chamber groups 23*s* belonging to the first individual channel array C1 and second individual channel array C2 (that is, all pressure chamber groups 23*s* formed in the channel substrate 311) are arranged zigzag in the channel longitudinal direction. By virtue of this, each pressure chamber group 23*s* is positioned differently from any other pressure chamber group 23*s* in the channel longitudinal direction.

In each individual channel 20, the first pressure chamber 23*a*, the first connecting channel 24*a* and first link channel 25*a*, the second pressure chamber 23*b*, and the second connecting channel 24*b* and second link channel 25*b* are arranged to interpose the nozzle 21 therebetween in the channel width direction, being symmetrical in the channel width direction with respect to a straight line along the channel longitudinal direction and through the nozzle 21. The first pressure chamber 23*a*, and the first connecting channel 24*a* and first link channel 25*a* are positioned closer to the supply channel 31 than the nozzle 21, or positioned to overlap with the supply channel 31 in the vertical direction. The second pressure chamber 23*b*, and the second connecting channel 24*b* and second link channel 25*b* are positioned farther from the supply channel 31 than the nozzle 21 in the channel width direction. Part of the first pressure chamber 23*a* and the first link channel 25*a* overlap with the supply channel 31 in the vertical direction. Part of the second pressure chamber 23*b* and the second link channel 25*b* overlap with the return channel 32 in the vertical direction.

Each first link channel 25*a* links the supply channel 31 and the first pressure chamber 23*a*. The first link channel 25*a* has one end (the inlet 20*a* of the individual channel 20) linking to the supply channel 31, and another end 25*a*2 linking to one end 23*a*1 of the first pressure chamber 23*a* in the channel width direction. The other end 25*a*2 is positioned in the center of the first pressure chamber 23*a* according to the width direction (the channel longitudinal direction in the third embodiment) at the one end 23*a*1.

Each second link channel 25*b* links the return channel 32 and the second pressure chamber 23*b*. The second link channel 25*b* has one end (the outlet 20*b* of the individual channel 20) linking to the return channel 32, and another end 25*b*2 linking to one end 23*b*1 of the second pressure chamber 23*b* in the channel width direction. The other end 25*b*2 is positioned in the center of the second pressure chamber 23*b* according to the width direction (the channel longitudinal direction in the third embodiment) at the one end 23*b*1.

In each pair, the first link channel 25*a* and the second link channel 25*b* are arranged to extend respectively in an oblique direction (a direction intersecting both the channel width direction and the channel longitudinal direction), and to be symmetrical in the channel width direction with respect to such a straight line along the channel longitudinal direction as passes through the center of the nozzle 21 according to the channel width direction. One end (the inlet 20*a*) of the first link channel 25*a* is positioned at one side in the channel longitudinal direction across from the other end 25*a*2 of the first link channel 25*a*. One end (the outlet 20*b*) of the second link channel 25*b* is positioned at one side in the channel longitudinal direction across from the other end 25*b*2 of the second link channel 25*b*. Further, the resistance of the first link channels 25*a* is the same as the resistance of the second link channels 25*b*.

In each individual channel 20, the inlet 20*a* and the outlet 20*b* are located at one side of the nozzle 21 in the channel longitudinal direction (both at the same side), and at the same position in the channel longitudinal direction. Further, in each individual channel 20, the distance from the supply port 31*x* to the inlet 20*a* in the channel longitudinal direction is the same as the distance from the outlet 20*b* to the return port 32*x* in the channel longitudinal direction. Further, in each individual channel 20, the channel resistance from the supply port 31*x* to the inlet 20*a* is the same as the channel resistance from the outlet 20*b* to the return port 32*x*. Further, the two supply channels 31 and the one return channel 32 have the same length respectively along the channel width direction and along the vertical direction, and have the same cross section area of channel.

Between the two supply channels 31, the supply channels 31 arranged at one side of the return channel 32 in the channel width direction is in communication with the inlets 20*a* of the individual channels 20 belonging to the first individual channel array C1. Between the two supply channels 31, the supply channels 31 arranged at the other side of the return channel 32 in the channel width direction is in communication with the inlets 20*a* of the individual channels 20 belonging to the second individual channel array C2. With each of the two supply channels 31, the inlets 20*a* of the individual channels 20 are arranged in one array in the channel longitudinal direction.

The return channel 32 is in communication with the outlets 20*b* of the individual channels 20 belonging to the second individual channel array C2. With the return channel 32, the outlets 20*b* of the individual channels 20 are arranged zigzag in the channel longitudinal direction.

Each first connecting channel 24*a* connects another end 23*a*2 of the first pressure chamber 23*a* in the channel width direction with one end 22*a* of the communication channel 22 in the channel width direction. The first connecting channel 24*a* connects to the center of the first pressure chamber 23*a* in the width direction (the channel longitudinal direction in the third embodiment) at the other end 23*a*2.

Each second connecting channel 24*b* connects another end 23*b*2 of the second pressure chamber 23*b* in the channel width direction with the other end 22*b* of the communication channel 22 in the channel width direction. The second connecting channel 24*b* connects to the center of the second pressure chamber 23*b* in the width direction (the channel longitudinal direction in the third embodiment) at the other end 23*b*2.

As depicted in FIG. 7, the first connecting channel 24*a* and the second connecting channel 24*b* extend respectively in the vertical direction.

The communication channels 22 are channels passing right above the nozzles 21 to extend in the channel width direction, respectively. Each of the communication channels 22 is positioned, as depicted in FIG. 6, at the center of the first pressure chamber 23*a* and the second pressure chamber 23*b* in the channel longitudinal direction. The nozzle 21 is arranged at the center of the communication channel 22 in the channel width direction.

As depicted in FIG. 7, the first pressure chamber 23*a* is in communication with the nozzle 21 via the first connecting channel 24*a* and the communication channel 22. The second pressure chamber 23*b* is in communication with the nozzle 21 via the second connecting channel 24*b* and the communication channel 22. The first pressure chamber 23*a* and the second pressure chamber 23*b* are in communication with each other via the first connecting channel 24*a*, the communication channel 22, and the second connecting channel 24*b*.

The one end 22*a* of the communication channel 22 connects to the first connecting channel 24*a* and is in communication with the supply channel 31 via the first pressure chamber 23*a* and the first link channel 25*a*. The other end 22*b* of the communication channel 22 connects to the second connecting channel 24*b* and is in communication with the return channel 32 via the second pressure chamber 23*b* and the second link channel 25*b*.

In such a channel configuration as described above, the ink flows in the channel substrate 311 in the following manner. The thick arrows in FIGS. 6 and 7 indicate the ink flow.

With the circulation pump 7*p* being driven under the control of the controller 5 (FIG. 1), the ink in the retaining chamber 7*a* is supplied to the supply channel 31 from the supply port 31*x*. Between the two supply channels 31, the ink supplied to the supply channel 31 arranged at one side of the return channel 32 in the channel width direction moves from one part to the other part in that supply channel 31 along the channel longitudinal direction, while being supplied to each individual channel 20 belonging to the first individual channel array C1. Between the two supply channels 31, the ink supplied to the supply channel 31 arranged at the other side of the return channel 32 in the channel width direction moves from one part to the other part in that supply channel 31 along the channel longitudinal direction, while being supplied to each individual channel 20 belonging to the second individual channel array C2. The ink having flowed into each individual channel 20 from the supply channel 31 moves in the individual channel 20 in an aftermentioned manner, and then flows into the return channel 32. Then, the ink moves from another part to one part in the return channel 32 along the channel longitudinal direction to return to the retaining chamber 7*a* via the return port 32*x*.

The ink having flowed into the individual channel 20 passes through the first link channel 25*a* and the first pressure chamber 23*a* from the inlet 20*a*, moves sufficiently horizontally, moves downward through the first connecting channel 24*a*, and then flows into the one end 22*a* of the communication channel 22. The ink moves horizontally through the communication channel 22, and part of the same is discharged from the nozzle 21 whereas the rest passes through the second connecting channel 24*b* from the other end 22*b* of the communication channel 22 and moves upward. The ink moves sufficiently horizontally through the second pressure chamber 23*b* and the second link channel 25*b*, and then flows into the return channel 32 from the outlet 20*b*.

As described above, according to the third embodiment, although there is a difference from the first embodiment in the number and arrangement of supply channels 31 and return channels 32 and in the configuration of individual channels 20, the inlets 20*a* and the outlets 20*b* of the individual channels 20 are located in the same position in the channel longitudinal direction. Therefore, in the same manner as in the first embodiment, it is possible to equalize the absolute values of the pressures on the inlet 20*a* and the outlet 20*b* of the individual channel 20, and thus it is possible to prevent the unstable discharging.

Further, in the third embodiment, the supply channels 31 and the return channel 32 align alternately in the channel width direction, and the individual channels 20 belonging to the first individual channel array C1 and the individual channels 20 belonging to the second individual channel array C2 link, respectively, the supply channels 31 and the return channel 32 which are adjacent to each other in the channel width direction. When each individual channel 20 includes two pressure chambers 23*a* and 23*b*, because a space is needed for providing the pressure chambers 23*a* and 23*b*, it becomes difficult to downsize the head 301 in the channel width direction. However, as in the third embodiment, because the first individual channel array C1 and the second individual channel array C2 share one supply channel 31, compared to the case of providing a pair of supply channel 31 and return channel 32 for each of the individual channels C1 and C2, it is still possible to downsize the head 301 in the channel width direction even in the configuration where each individual channel 20 includes two pressure chambers 23*a* and 23*b*.

In the same manner as in the first embodiment, the first link channel 25*a* and the second link channel 25*b* extend in the oblique direction (the direction intersecting the channel width direction and the channel longitudinal direction; see FIG. 6). In this case, under the condition that each of the link channels 25*a* and 25*b* has a constant length, compared to the case where the first link channels 25*a* and the second link channels 25*b* extend in the channel width direction, it is possible to downsize the head 301 in the channel width direction.

Further, in the same manner as in the first embodiment, the one end (the inlet 20*a*) of the first link channel 25*a* is positioned at one side in the channel longitudinal direction as in reference to the other end 25*a*2 of the first link channel 25*a* (see FIG. 6). The one end (the outlet 20*b*) of the second link channel 25*b* is positioned at one side in the channel longitudinal direction as in reference to the other end 25*b*2 of the second link channel 25*b*. That is, in each pair of the first link channel 25*a* and the second link channel 25*b*, one end (the inlet 20*a* or the outlet 20*b*) is positioned closer to the supply port 31*x* and the return port 32*x* than the other end 25*a*2 or 25*b*2. In this case, because the absolute values of the pressures applied on the inlet 20*a* and the outlet 20*b* are large, there is more flow quantity of the ink supplied to the nozzle 21 such that it is possible to prevent under-refill phenomenon.

Further, in the same manner as in the first embodiment, in each pair, the first link channel 25*a* and the second link channel 25*b* are arranged to be symmetrical with respect to the channel width direction (see FIG. 6). In this case, in the first link channel 25*a* and the second link channel 25*b*, there is a small difference in inertial resistance. Therefore, there is a small difference in pressure loss. By virtue of this, it is easy to adjust pressure for the individual channel 20.

Further, in the same manner as in the first embodiment, the first link channel 25*a* has the same resistance as the second link channel 25*b*. In this case, there is a small difference in the pressure loss between the first link channel 25*a* and the second link channel 25*b* such that it is easy to adjust pressure for the individual channel 20.

Further, in the same manner as in the first embodiment, in the return channel 32, the outlets 20*b* of the individual channels 20 are arranged zigzag along the channel longitudinal direction (see FIG. 6). In this case, compared to the case of aligning the outlets 20*b* in one array in the channel longitudinal direction, there is an improved effect of stirring the precipitation ingredients because convection arises easily inside the return channel 32.

Further, in the same manner as in the first embodiment, the distance from the supply port 31*x* to the inlet 20*a* in the channel longitudinal direction is the same as the distance from the outlet 20*b* to the return port 32*x* in the channel longitudinal direction (see FIG. 6). In this case, it is possible to more reliably equalize the absolute values of the pressures on the inlet 20*a* and the outlet 20*b* of the individual channel 20, and thus it is possible to prevent the unstable discharging.

Further, in the same manner as in the first embodiment, the channel resistance from the supply port 31*x* to the inlet 20*a* is the same as the channel resistance from the outlet 20*b* to the return port 32*x*. In this case, it is possible to more reliably equalize the absolute values of the pressures on the inlet 20*a* and the outlet 20*b* of the individual channel 20, and thus it is possible to prevent the unstable discharging.

Modified Embodiments

Hereinabove, a few embodiments of the present teaching were explained. However, the present teaching is not limited to the above embodiments but can be changed with various designs without departing from the true spirit and scope set forth in the appended claims.

As far as the inlet and the outlet of each individual channel are located at the same position in the channel longitudinal direction, the first link channel and the second link channel may extend in any direction. For example, even if the first link channel and the second link channel extend in the channel width direction but not in the oblique direction, as far as the inlet and the outlet of each individual channel are located at the same position in the channel longitudinal direction, then it is still possible to equalize the absolute values of the pressures on the inlet and the outlet of the individual channel, and thus possible to prevent the unstable discharging.

In the case where the first link channel and the second link channel extend in the oblique direction, one end of each of the link channels corresponding to the inlet and the outlet of each individual channel may be located at a farther position from the supply port and the return port than the other end of each link channel. Further, the first link channel and the second link channel may be arranged asymmetrically with respect to the channel width direction, without being limited to the symmetry arrangement in the channel width direction.

The number of each of supply channels and return channels is not particularly limited but may be one or more. For example, while the number of common channel groups is three in the first and second embodiments (FIGS. 2 and 4), the number of common channel groups may be one, two, four or more. Further, in the third embodiment (FIG. 6), while the total number of supply channels and return channels is three, the total number of supply channels and return channels may be two, four or more. Further, in the third embodiment (see FIG. 6), two supply channels and one return channel are aligned alternately in the channel width direction and the one return channel is arranged between the two supply channels in the channel width direction. However, two return channels and one supply channel may be aligned alternately in the channel width direction, and the one supply channel be arranged between the two return channels in the channel width direction.

If the supply channels and the return channel are aligned in the channel width direction (FIG. 6), then the present teaching is not limited to the alternate alignment. For example, at the center according to the channel width direction, two supply channels or two return channels may be arranged adjacent to each other (that is, without interposing another supply channel or return channel therebetween).

Each of the inlet and the outlet of each individual channel is not limited to being positioned in the upper or lower surface of the supply channel or the return channel, but may be positioned at a lateral surface of the supply channel or the return channel.

In the first embodiment (FIG. 3), the outlet of the individual channel is positioned at the end of the lower surface of the return channel in the channel width direction, and a damper is provided on the other side than the outlet in the channel width direction across the return channel. However, without being limited to that, for example, the outlet of the individual channel may be positioned at the vertical end of a lateral surface of the return channel in the channel width direction, and the damper be provided on the other side than the outlet in the channel width direction across the return channel.

The supply ports and the return ports are not limited to being open in the upper surface of the channel substrate, but may be open in the lower surface or a lateral surface of the channel substrate.

In the first embodiment (FIG. 2) and the second embodiment (FIG. 4), two individual channel arrays may be provided not only for the common channel group 30*b* in the center according to the arrayal direction, but may also be provided for the common channel groups 30*a* and 30*c* at the two ends according to the arrayal direction.

The number of nozzles included in each individual channel is not limited to one but may be two or more.

The number of pressure chambers included in each individual channel is limited to neither one nor two but may be three or more.

The actuator is not limited to a piezo type using piezoelectric elements but may adopt another type (such as a thermal type using thermal elements, a static type using electrostatic force, and the like).

The liquid discharged from the nozzles is not limited to an ink but may be any liquid (such as a processing liquid of agglutination or deposition of the ingredients of the ink).

The heads are not limited to the line type but may be the serial type (a discharging method for discharging the liquid to a discharging object from nozzles while the heads are moving in a direction parallel to the paper width direction).

In the above embodiments, a direction parallel to the conveyance direction corresponds to the "channel width direction", and the paper width direction corresponds to the "channel longitudinal direction". However, without being limited to that, for example, the supply channels and the return channels may extend in a direction parallel to the conveyance direction, and the direction parallel to the conveyance direction corresponds to the "channel longitudinal direction" while the paper width direction corresponds to the "channel width direction".

The present teaching is not limited to application to printers but is also applicable to facsimile devices, photocopy devices, multifunction devices, and the like. Further, the present teaching is also applicable to liquid discharge apparatuses used for other purposes than image recordings (such as liquid discharge apparatuses adapted to form electrically conductive patterns by discharging an electrically conductive liquid onto a substrate).

What is claimed is:

1. A liquid discharge head comprising:
an individual channel;
a supply channel in communication with an inlet of the individual channel; and
a return channel in communication with an outlet of the individual channel,
wherein the supply channel extends in a channel longitudinal direction, and communicates with a retaining chamber for retaining liquid, via a supply port provided at one side in the channel longitudinal direction with respect to the individual channel,
wherein the return channel extends in the channel longitudinal direction, and communicates with the retaining chamber, via a return port provided at the one side in the channel longitudinal direction with respect to the individual channel,
wherein the individual channel has:
a nozzle;
a pressure chamber in communication with the nozzle;
a connecting channel connecting the pressure chamber and the nozzle;
a first link channel having one end as the inlet and the other end linking to the pressure chamber; and
a second link channel having one end as the outlet and the other end linking to the connecting channel, and
wherein the inlet and the outlet are located at the same position in the channel longitudinal direction.

2. The liquid discharge head according to claim 1, wherein the supply channel and the return channel are arranged in a direction orthogonal to both of the channel longitudinal direction and a channel width direction which is orthogonal to the channel longitudinal direction and which is a width direction of each of the supply channel and the return channel.

3. The liquid discharge head according to claim 1, wherein the first link channel and the second link channel extend in a direction intersecting with both of the channel longitudinal direction and a channel width direction which is orthogonal to the channel longitudinal direction and which is a width direction of each of the supply channel and the return channel.

4. The liquid discharge head according to claim 3,
wherein the one end of the first link channel is positioned at the one side in the channel longitudinal direction with respect to the other end of the first link channel, and
wherein the one end of the second link channel is positioned at the one side in the channel longitudinal direction with respect to the other end of the second link channel.

5. The liquid discharge head according to claim 1, wherein the first link channel and the second link channel are arranged symmetrically in a channel width direction which is orthogonal to the channel longitudinal direction and which is a width direction of each of the supply channel and the return channel.

6. The liquid discharge head according to claim 1, wherein the first link channel has the same resistance as the second link channel.

7. The liquid discharge head according to claim 1,
wherein a damper film is provided on a side opposite to the outlet with respect to the return channel in an orthogonal direction orthogonal to the channel longitudinal direction, and
wherein the outlet is positioned at an end of the return channel in a direction orthogonal to both of the channel longitudinal direction and the orthogonal direction.

8. The liquid discharge head according to claim 1,
wherein the individual channel is one of individual channels, and
wherein in the return channel, outlets of the individual channels are arranged zigzag in the channel longitudinal direction.

9. The liquid discharge head according to claim 1, wherein the outlet is positioned at a center of the return channel in a channel width direction which is orthogonal to the channel longitudinal direction and which is a width direction of each of the supply channel and the return channel.

10. The liquid discharge head according to claim 1, wherein a distance from the supply port to the inlet in the channel longitudinal direction is same as a distance from the outlet to the return port in the channel longitudinal direction.

11. The liquid discharge head according to claim 1, wherein a channel resistance from the supply port to the inlet is same as a channel resistance from the outlet to the return port.

12. A liquid discharge head comprising:
an individual channel;
a supply channel in communication with an inlet of the individual channel; and
a return channel in communication with an outlet of the individual channel,
wherein the supply channel extends in a channel longitudinal direction, and communicates with a retaining chamber for retaining liquid, via a supply port provided at one side in the channel longitudinal direction with respect to the individual channel,
wherein the return channel extends in the channel longitudinal direction, and communicates with the retaining chamber, via a return port provided at the one side in the channel longitudinal direction with respect to the individual channel,
wherein the individual channel has:
a nozzle;
a first pressure chamber in communication with the nozzle;
a second pressure chamber in communication with the nozzle;
a first connecting channel connecting the first pressure chamber and the nozzle;
a second connecting channel connecting the second pressure chamber and the nozzle;

a first link channel having one end as the inlet and the other end linking to the first pressure chamber; and a second link channel having one end as the outlet and the other end linking to the second pressure chamber, and wherein the inlet and the outlet are located at the same position in the channel longitudinal direction.

13. The liquid discharge head according to claim 12, wherein the supply channel and the return channel are arranged in a channel width direction which is orthogonal to the channel longitudinal direction and which is a width direction of each of the supply channel and the return channel, and wherein the individual channel links the supply channel and the return channel arranged in the channel width direction.

* * * * *